US005430956A

United States Patent [19]

Lange

[11] Patent Number: 5,430,956

[45] Date of Patent: Jul. 11, 1995

[54] PROCESS AND DEVICE TO DRY LAUNDRY AND THE LIKE

[75] Inventor: Wilhelm Lange, Duisburg, Germany

[73] Assignee: SEMTEC Muller OHG, Sudstrasse, Germany

[21] Appl. No.: 949,553

[22] PCT Filed: May 17, 1991

[86] PCT No.: PCT/DE91/00408

§ 371 Date: Nov. 18, 1992

§ 102(e) Date: Nov. 18, 1992

[87] PCT Pub. No.: WO91/18142

PCT Pub. Date: Nov. 28, 1991

[30] Foreign Application Priority Data

May 18, 1990 [DE] Germany ..... 40 15 963.9
Sep. 19, 1990 [DE] Germany ..... 40 29 538.9
Sep. 19, 1991 [DE] Germany ..... 41 04 989.6

[51] Int. Cl.[6] ..... D06F 58/02

[52] U.S. Cl. ..... 34/408; 34/514; 34/86

[58] Field of Search ..... 34/73, 76, 79, 86, 35, 34/133 G, 133 H, 406, 407, 408, 413, 402, 403, 405, 513-515

[56] References Cited

U.S. PATENT DOCUMENTS 1,309,357 7/1919 Falk et al. ..... 34/406
2,627,669 2/1953 Candor ..... 34/76
3,762,065 10/1973 Wahlgren ..... 34/73
4,347,671 9/1982 Dias et al. ..... 34/408

FOREIGN PATENT DOCUMENTS 2430314 1/1976 Germany .

OTHER PUBLICATIONS

Periodical "Siemens-Zeitschrift", vol. 33, 1959, No. 4, pp. 281 & 282.

*Primary Examiner*—Denise L. Gromada
*Attorney, Agent, or Firm*—Jones, Tullar & Cooper

[57] ABSTRACT

A process and a device for evacuating a drying room filled with one or more evaporable fluids or one or more non-evaporable fluids or mixtures thereof. The device includes a turbo engine, a liquid seal pump and a condensor. The pressure of the fluids or mixture of fluids is raised by the turbo engine, the resulting volume flow is reduced by condensation in the condensor, and the resulting reduced volume flow is pumped off with the pump.

16 Claims, 3 Drawing Sheets

PROCESS AND DEVICE TO DRY LAUNDRY AND THE LIKE

BACKGROUND OF THE INVENTION

1. Field of the Invention

The present invention relates to a process and a device to dry a drying room.

2. Prior Art

The German Patent DE 36 44 077 A1 and EP0043 361 A1 reveal a process and a device to dry wet laundry. Such systems are however technically seen as very complicated and the drying process as very time consuming. This is so because the high inlet volume flow is difficult to handle and because the non condensable gases in the inlet volume flow, such as air or the like, are difficult to extract. Additionally the energy consumption is very high.

Another known drying process uses a rotary sliding vane type compressor or a liquid seal pump to pump condensable gases as well as non condensable gases. However, it is importent that the temperature of the liquid ring is considerably lower than the temperature of the inlet gas otherwise the liquid of the liquid ring of the pump will evaporate due to the fact that the boiling pressure is reached. At this point practically no compression takes place. If the temperature of the liquid ring or the water jet considerably below the temperature of the condensing fluid, good results are achieved.

With a gas ballast device in a rotary sliding vane type compressor the working fluid can attain higher pressure ratios. The disadvantage is a lower efficiency and the following condensation is more difficult due to the lack of non condensable gases.

Another generally known method to evacuate a room filled with condensable and non condensable gases is the use of a gas jet pump for the first stage of compression to avoid cavitation. The disadvantage is the necessity of a gas source and the mixture of condensable and non condensable fluids.

A general problem is the very high inlet volume flow of the gas mixture at the beginning of compression. It is possible to use a roots pump or a rotary sliding vane type compressor. However, this is an expensive investment as a large space for a big pump is needed.

Further, it is generally known from the publication, H. D. Baehr, "Thermodynamik", Springer Verlag 4th edition, 1978, pages 289–292, and especially FIG. 6.48, to approximate a compression process to the Carnot cycle by intermediate cooling.

Therefore it is an object of the present invention to have a process and a device to dry a drying room by means of a few small elements with the need of little energy.

SUMMARY OF THE INVENTION

This object is attained according to the present invention by a special process e.g. by first raising the pressure of the gas mixture to be evacuated by means of a turbo pump to such an extent that in the next step the fluid or fluid mixture respectively can be compressed and the rising liquid can be carried away with a pump with an eccentric liquid ring or a liquid jet pump.

By this method the inner section of the dryer has a lower pressure and the boiling point of one or more fluids in the container are lowered. If there is wet laundry in the container the boiling point of the water is lowered till the water evaporates. Hence, the laundry can be dried at a lower pressure and at a temperature slightly above room temperature. An additional advantage is the carefull treatment since only a low temperature and little mechanical load is necessary. The laundry is left loosly mixed in the container. On top of that it is sterilised since most life can not withstand such a low pressure. Finally energy consumption, in the range of 40%, is much lower relative to the above mentioned processes.

Here the evaporating fluid is a mixture of air and water and in the container of the drier is air and wet laundry. By evacuating the container, water in the form of steam and air as a gas mixture is removed from the container.

The air is evacuated with a liquid seal pump and the steam will be condensated to avoid a high inlet volume flow. To have a sufficient pressure of water/steam above the boiling point of the water, a turbo pump is used to build the water in the liquid seal pump. This arrangement will raise the pressure of the mixture of air and water/steam. The pressure ratio can be low, while the volume flow is quite high. The air which prevents an efficient condensation is evacuated after a short time. It is preferred to use a condenser for the fluid or the mixture of fluids after the first compression stage.

It is seen as an advantage to cool the fluid or mixture of fluids in a heat exchanger to at least partly condense the steam and then let the fluid or mixture of fluids be further compressed and let the steam by further condensed.

A further advantage is seen if the condensed steam is collected in a special container for further usage. For example, the condensed water can be used for ironing or can be used to run the liquid seal pump or the water jet pump to avoid the usage of an external water source. Preferably, the special container with the condensate is cooled with a cool fluid flow.

It is seen as an advantage to use the condensation heat and/or the extracted heat of one or more of the non condensing gases to heat the non evaporative fluid or mixture of fluids.

Preferably the fluid or mixture of fluids will be further compressed in a diffusor after compression in the impeller.

If the diffusor following the turbo pump is built as one piece with the heat exchanger further advantages are gained. A smaller device volume is achieved and there is a heat exchange occuring already during the compression in the diffusor.

A further advantage is gained if the non evaporative fluid or mixture of fluids is heated with the excess heat of the driving motor.

A further advantage is gained if the non evaporating fluid or fluid mixture is guided first across a cool moving drum then through a heat exchanger and finally a feed pump. In this way, the warm non evaporating fluid heats the cool drum and consequently the cool partly dry laundry is heated. This added heat is for example the condensation heat of the evaporated fluid. Preferably the outlet pipe of the pump unit or the compressor unit is mounted within the device.

A very good arrangement of the cycle with the non evaporating fluids is achieved if these first very warm fluids are guided to the cool drum and as a result being cooled down. A fraction of the cool flow can be used to cool the condensate in the special condensate container. The main flow of the cool liquid will be used in the heat exchanger to condense the compressed mixture of gases partly or completely. Raising the heat reduces the viscosity of the liquid, which is an advantage in view of the pressure losses in the following pipes. An additional joint for cooling is saved by this method.

Preferably, a single driving motor is used to drive the liquid seal pump, the feed pump, with a gear, the turbo pump, the drum and, further units, if present.

The above mentioned object is achieved according to the present invention with a gas tight device, a container for evaporative and non evaporative fluids, a turbo engine to precompress the evaporative fluids or mixture of fluids respectively, and a liquid seal pump to evacuate the evaporative fluid or mixture of fluids respectively.

A turbo compressor is understood to be a continuous working compressor of the axial or radial type. Mixed types, as semiaxial, are possible. The turbo compressor might consist of a single radial impeller followed by a diffuser. By means of the turbo compressor the evaporative fluid will be precompressed with the effect of a raising the pressure or raising the temperature of the fluid or mixture of fluids respectively. The fluid will then be evacuated by a liquid seal pump or by a liquid jet pump without the risk of evaporation or cavitation within the pump. The turbo compressor can be driven at high speed having the advantage of a high inlet volume flow combined with the advantage of small resulting dimensions.

In a preferred design the turbo compressor is followed by a condenser. This is to reduce the volume flow and for the extraction of heat out of the mixture of fluids. The heat exchanger condenses the mixture of fluids partially or completely. A strong reduction of the volume flow results. By doing this a small seized liquid seal pump or liquid jet pump can be used after this step. The temperature of the mixture of fluids is as much above the temperature of the liquid seal or the liquid jet respectively in the pump that evaporation and/or cavitation of the liquid seal or the liquid jet respectively is avoided.

Because this cycle is run at a very low pressure, suction is only possible when a sufficient geodetical hight is given. This geodetical hight is chosen in such a way that in connection with cross sections of the flow channels in the device the heat transfer in the heat exchanger is high enough and a sufficient velocity at the inlet of the feed pump is maintained to avoid cavitation in the feed pump. After that the flow of the liquid is directed to the cool wall of the drum.

A further design has a siphon following the condenser. Such a siphon can also be used after the liquid seal pump or liquid jet pump.

If the liquid seal pump or the liquid jet pump can take condensed liquid the siphon after the condenser is not necessary.

Preferably a gear pump after the siphon is used to remove the condensed liquid.

In a prefered design of the device the liquid seal pump partly uses the condensed fluid.

In a different design a single driving device is used to drive the turbo engine, the liquid seal pump, a gear pump and, if applicable, a feed pump.

There is an advantage to having the driving device mounted within the container, for example within the non evaporating and especially electrically non conducting fluid. By doing this the dissipative heat of the pump or the compressor unit can be utilized to heat the drying laundry.

In a very prefered design, the flow of the non evaporative fluid will be used to cool the driving motor after running through the heat exchanger. In this way the dissipative power of the driving device is used in an effective way to heat the drying product. Therefore there is the possibility to choose a smaller driving motor since the power of a driving motor is limited by excessive heat and the cooling reduces the temperature.

Generally a problem with vacuum equipment is the insurance of the thightness of the seals, because a high leakage causes air to flow through open cross sections with the speed of sound, and hence, a high inlet volume flow of vacuum pumps results. Therefore it is a specific advantage that at most one seal for a small driving shaft leading into the evacuated room is needed. All other seals are static and only a very small leakage has to be assumed. Further, a small and economic design is achieved since with this driving shaft all other units are driven. These are the feed pump drive, the non evaporative fluid, the drive of the turbo machine by a speed increasing gear, and the drive of the drum by a speed reducing gear etc. If applicable other units can be driven as well.

In a special design the driving shaft is connected to the shaft of the driving motor of the liquid seal pump or another driven unit since an additional driving motor is saved and especially a driving unit within the evacuated room. In one design the turbo machine is mounted within the container.

There is an advantage to use an open-loop controlling device or a close-loop controlling device to have small dynamic peak moments and hence, to have smaller components. Further on, in this way there are means to influence the pressure and temperature as a function of time for example to avoid an excessive need of power during the start-up because, for example, a high density of the mixture of gases leads to a high compressor power of the tubo engine and large components would result.

There is an advantage if the container has special bodies which press the laundry against the wall of the container and have a heat capacity to warm up cooled down laundry in the surroundings by means of bodies able to spend heat.

There is an advantage if the bodies are filled with material which will by changing its own phase, spend heat and possibly have an increased its heat capacity due to this feature.

There is an advantage if the container has a microwave transmitter to accelerate the drying process by at least enhancing or supporting the evaporating of the fluid especially if the heat conductivity in the dry product is very low.

Further advantages, features and details result from the following description where a prefered example is described by making references to drawings. In the invention the described features may be combined in any order.

DETAILED DESCRIPTION OF THE PREFERRED EMBODIMENTS

Figure 1:
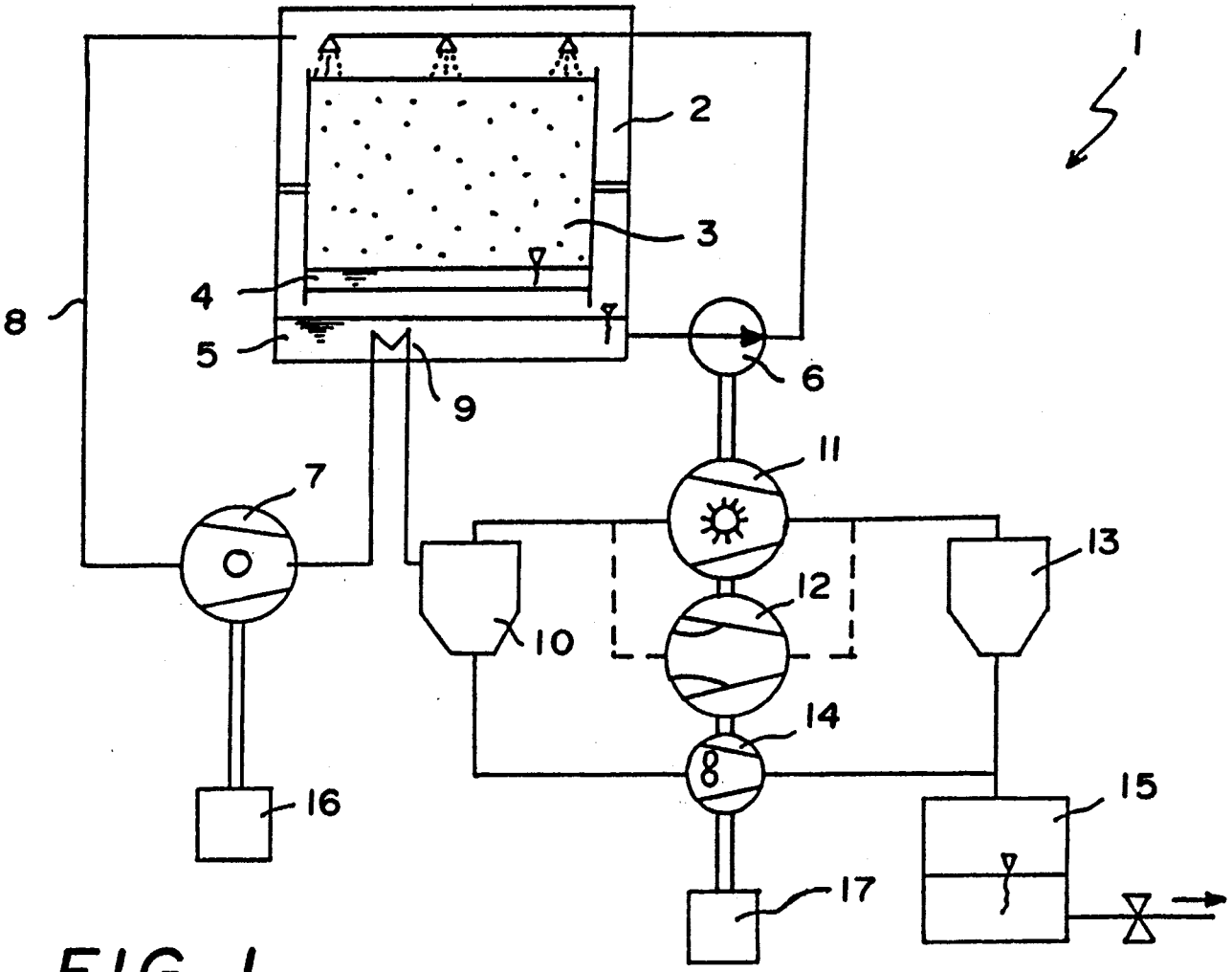
FIG. 1 shows a diagram of a drying device.

FIG. 1 shows a diagram of a drying device 1 with a drying room 2 which can be evacuated and which has a mixture of fluids consisting of one or more evaporative fluids (for example, water) and one or more non evaporative fluids. The fluids can consist of gases and/or liquids labeled 4 and 5. To have an effective heat transfer the non evaporating liquid 5 is sprayed within the drying room 2 by means of a feed pump 6. The feed pump 6 is connected with the drying room 2 containing a sump with the non evaporative liquid.

With the drying room 2 containing the mixture of fluids 3 connected by an intake pipe 8 is a turbocompressor 7, followed by a condenser 9. The condenser 9 is mounted within the drying room 2. Following the condenser 9 is a siphon 10 whose outlet pipe with the collected liquid is connected to a gear pump, such as, for example, a positive-displacement pump 14. The exhaust pipe of the siphon 10 for the gas is connected to a liquid seal pump 11 followed by a further siphon 13. Parallel or in exchange to the liquid seal pump 11, a liquid jet pump can be used as shown by the dashed line. Finally the flow from the positive-displacement pump 14 as well as the flow from the liquid jet pump is reaching a reservoir 15 in which the evaporative fluid of the drying room 2 is collected.

The turbocompressor 7 aspirates the mixture of fluids 3 and raises its pressure at least to such a level that the pressure losses in the intake pipe 8, the condenser 9, and the siphon 10 together with the related pipes and together with the intake losses of the liquid seal pump 11 are compensated for. By this method cavitation and/or evaporation of the liquid seal in the liquid seal pump 11 are prevented. After the pressure rise produced by the turbocompressor 7, the mixture of fluids 3 runs through the condenser 9 where the compressed mixture of fluids 3 is cooled and the non evaporative liquid 5 is heated. After the condenser 9, the mixture of fluids 3 reaches the siphon 10 where the liquid components are separated from the gaseous components. The latter components are pumped off by the liquid seal pump 11. With the liquid jet pump 12 this pumping and condensating can be done alternatively or parallel.

According to the desired procedure, the compressed mixture of fluids can be carried away together with the condensed liquid, or it can be separated in the further siphon 13 e.g. the permanent gas will be released and the condensed liquid will be collected in the reservoir 15.

Basically all pumps and compressors 6, 7, 11, 12, and 14 can be driven by a single drive or groups of these components can be driven by a single drive. An especially prefered design has a fast drive for the turbocompressor and 9 slow drive for the pumps and compressor(s) 6, 11, 12 and 14.

A very simplified design has no siphon 10 and 13, no positive-displacement pump 14 and no reservoir 15.

Figure 2:
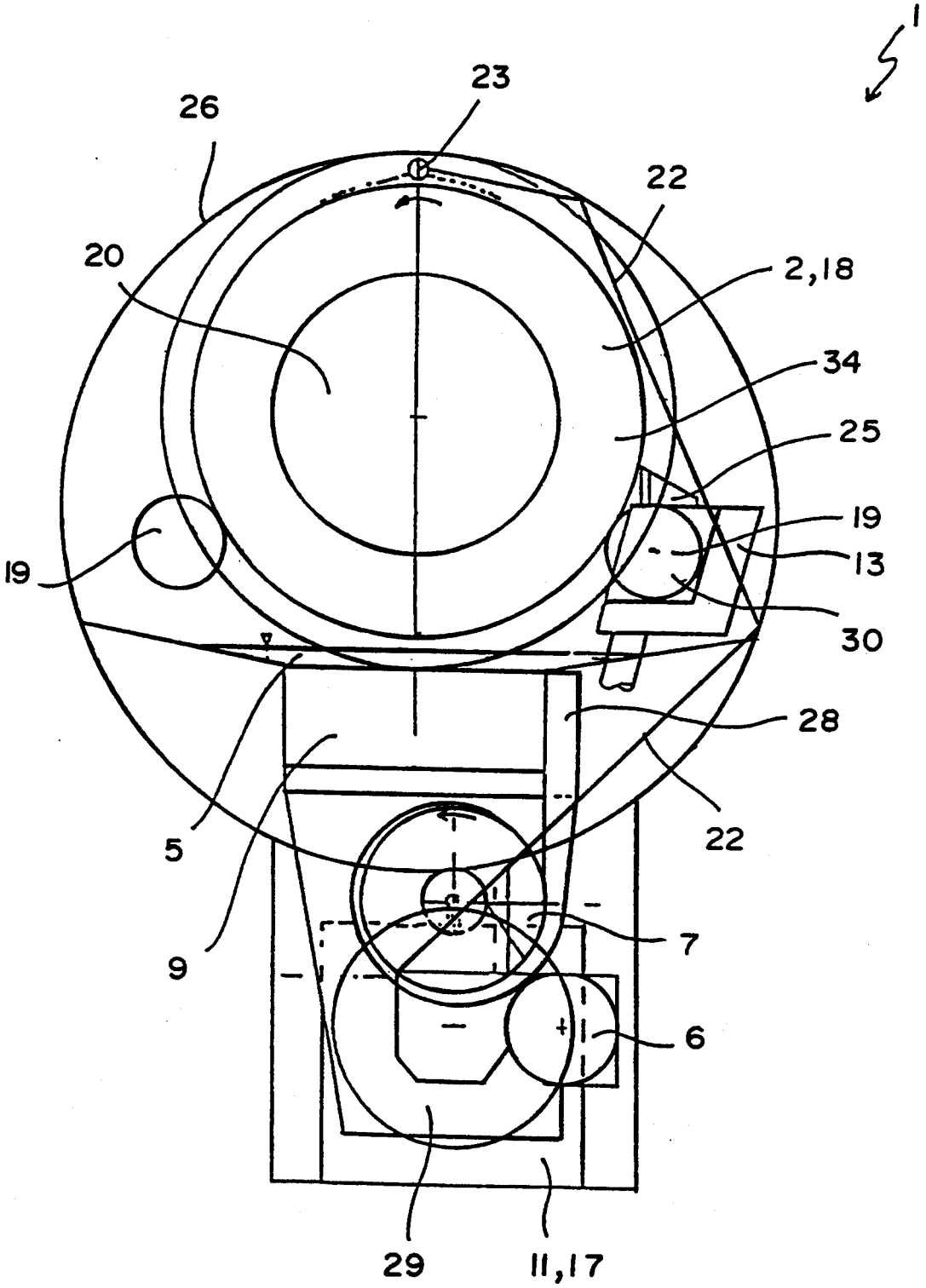
FIG. 2 shows a cross section of the drying device according FIG. 3.
Figure 3:
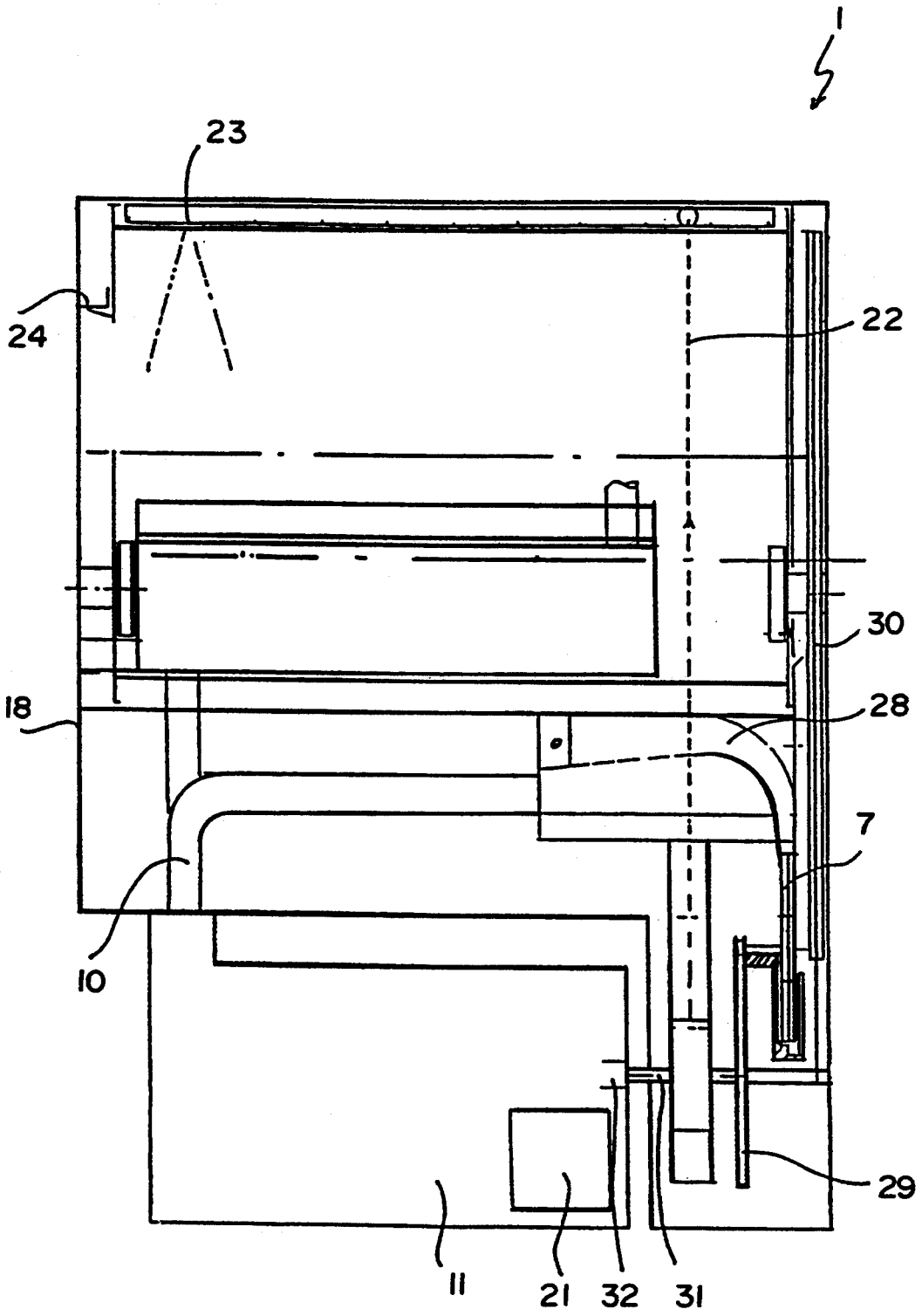
FIG. 3 shows a longitudinal view of the drying device according FIG. 2.

FIG. 2 shows a cross section of a drying device 1 and FIG. 3 a longitudinal view of a drying device 1 in which the drying room will be evacuated. By doing this the drying room is dried simultaneously. In the drying room 2 is a laundry drum 13 containing moist laundry e.g. laundry and the mixture of fluids 3 consisting of the permanent gas (air) and evaporative fluid (water). Further, in the drying room 2 is the non evaporative and odorless fluid 5. Entry into the drum 18, which is pivoted on rollers 19, is through an opening 20. It is prefered to drive the rollers by a gear drive driven by the drive 17. This drive has an open-loop drive 21 to avoid high peak moments of the driven parts in the device, especially during start-up when there is a high pressure and hence, a high mechanical load in the device.

Above the level of the non evaporative liquid 5, the drum 18 is mounted. The liquid 5 is fed through a pipe 22 to spray nozzles 23 by the feed pump 6 to spray liquid equally onto drum 18. By doing this the drum 18 as well as the laundry within the drum 18 is heated. Penetration of the liquid 5 into the drum 18 is prevented by suitable barriers 24 or labyrinth seals, respectively. A skimmer 25 separates non-evaporative fluid 5 from the drum 18 and guides it to the siphon 13. A further cooling of the siphon 13 is gained by connecting it together with the pressure tank 26 and the cold lid 27, as though of one piece.

The turbocompressor 7, mounted underneath the drum 18, aspirates the evaporative fluid through a diffusor 28 and brings the compressed mixture of fluids 3 to the condenser 9. This condenser 9 is mounted within the sump of the non-evaporative fluid 5 to heat the non-evaporative liquid 5 by the compressed mixture of fluids 3. Behind the liquid seal pump 11 the fluid will be forced to the siphon 13 to separate the gas (permanent gas) and condensated liquid.

The feed pump 6, a high speed gear 29 to drive the turbocompressor 7 and a low speed gear 30 to drive the drum 18 will be driven by a thin drive shaft 32 connected to the liquid seal pump 11.

What is claimed is:

1. A process for evacuating a drying room filled with fluid comprising at least one of an evaporable fluid, a non-evaporable fluid and mixtures thereof, comprising the steps of:

raising the pressure of said at least one fluid, and mixture thereof by a turbo engine;

reducing the resulting volume flow by condensation in a condensor; and pumping off the resulting reduced volume flow with a pump.

2. The process of claim 1, wherein the pump includes an eccentric liquid ring.

3. The process of claim 1, wherein the pump comprises a liquid jet pump.

4. The process of claim 1, further comprising the step of:

transferring the heat of condensation of at least one of the permanent gases produced to at least one of a non-evaporable fluid and mixture of fluids.

5. A device to evacuate and dry a substantially gas tight drying room containing evaporable and non-evaporable fluids, comprising:

a turbo engine connected to the drying room to compress at least one of the evaporable fluids and mixture of fluids;

a liquid seal pump connected to the drying room for exhausting at least one of the compressed evaporable fluids and mixture of fluids; and a condensor connected between the turbo engine and the liquid seal pump serving the reduce the volume flow.

6. The device of claim 5, further comprising:

a siphon for collecting liquid, wherein the liquid seal pump contains partly the liquid collected in the siphon.

7. The device of claim 5, further comprising:

a single drive; and a gear pump, wherein the turbo engine, the liquid seal pump and the gear pump are driven by the single drive.

8. The device of claim 7, wherein the drive is mounted within a container.

9. The device of claim 7, wherein the turbo engine is mounted within a container.

10. The device of claim 7, wherein the drive and turbo engine is mounted within a container.

11. The device of claim 7, wherein the drive is mounted within the non-evaporable fluid to increase the usable heat and to have sufficient cooling for the drive.

12. The device of claim 7, wherein the drive is mounted before the non-evaporable fluid to increase the usable heat and to have sufficient cooling for the drive.

13. The device of claim 5, further comprising:

a gear pump; and a feed pump, wherein the turbo engine, the liquid seal pump, the gear pump and the feed pump are driven by a single drive.

14. A process for evacuating a drying room filled with fluid comprising at least one of an evaporable fluid, a non-evaporable fluid and mixtures thereof, comprising the steps of:

raising the pressure of said at least one fluid, and mixture thereof by a turbo engine;

reducing the resulting volume flow by condensation in a condensor;

pumping off the resulting reduced volume flow with a pump; and further condensing the pumped off resulting reduced volume flow.

15. A process for evacuating a drying room filled with fluid comprising at least one of an evaporable fluid, a non-evaporable fluid and mixtures thereof, comprising the steps of:

raising the pressure of said at least one fluid, and mixture thereof by a turbo engine;

reducing the resulting volume flow by condensation in a condensor;

pumping off the resulting volume flow with a pump; and heating at least one of the non-evaporable fluid and mixture of fluids by the waste heat of a drive motor.

16. A process for evacuating a drying room filled with fluid comprising at least one of an evaporable fluid, a non-evaporable fluid and mixtures thereof, comprising the steps of:

raising the pressure of said at least one fluid, and mixture thereof by a turbo engine;

reducing the resulting volume flow by condensation in a condensor;

pumping off the resulting reduced volume flow with a pump; and guiding at least one of the fluids and mixture of fluids across a movable and cool drum and then via a heat exchanger to a feed pump.

* * * * *